US007025035B1

(12) United States Patent
Duty et al.

(10) Patent No.: US 7,025,035 B1
(45) Date of Patent: Apr. 11, 2006

(54) METHOD AND CODE FOR DETERMINING EVENT-BASED CONTROL DELAY OF HYDRAULICALLY-DEACTIVATABLE VALVE TRAIN COMPONENT

(75) Inventors: Mark J Duty, Goodrich, MI (US); Michael A Bonne, Leonard, MI (US); Michael J Prucka, Grass Lake, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 11/064,631

(22) Filed: Feb. 24, 2005

(51) Int. Cl.
*F02B 77/00* (2006.01)

(52) U.S. Cl. ..... 123/198 F; 701/101

(58) Field of Classification Search ..... 123/198 F; 701/101
See application file for complete search history.

(56) References Cited

U.S. PATENT DOCUMENTS

| | | | |
|---|---|---|---|
| 6,752,121 | B1 | 6/2004 | Rayl et al. |
| 2002/0162540 | A1 | 11/2002 | Matthews et al. |
| 2004/0244744 | A1 | 12/2004 | Falkowski et al. |
| 2004/0244751 | A1 | 12/2004 | Falkowski et al. |

OTHER PUBLICATIONS

Bates, B.; Dosdall, J. M.; and Smith, D. H.; "Variable Displacement by Engine Valve Control," SAE Paper No. 780145 (New York, NY; 1978).
Mueller, Robert S.; and Uitvlugt, Martin W.; "Valve Selector Hardware," SAE Publication No. 780146 (New York, NY; 1978).
Fukui, Toyoaki; Nakagami, Tatsuro; Endo, Hiroyasu; Katsumoto, Takehiko; and Danno, Yoshiaki; "Mitsubishi Orion-MD—A New Variable Displacement Engine," SAE Paper No. 831007 (New York, NY; 1983).
Hatano, Kiyoshi; Iida, Kazumasa; Higashi, Hirohumi; and Murata, Shinichi; "Development of a New Multi-Mode Variable Valve Timing Engine," SAE Paper No. 930878 (New York, NY; 1993).
McElwee, Mark; and Wakeman, Russell; "A Mechanical Valve System with Variable Lift, Duration, and Phase Using a Moving Pivot," SAE Paper No. 970334 (New York, NY; 1997).

(Continued)

*Primary Examiner*—Noah P. Kamen
(74) *Attorney, Agent, or Firm*—Ralph E. Smith

(57) ABSTRACT

A method for determining an event-based hydraulic control delay in a multi-displacement system for an internal combustion engine, with which to adjust the triggering a solenoid in hydraulic communication with a hydraulically-deactivatable valve train component, includes retrieving either a first mapped value representative of a time-based hydraulic deactivation delay, or a second mapped value representative of a time-based hydraulic reactivation delay, based on a current engine speed and a current oil temperature, preferably using different lookup tables for each of the first and second mapped values. The method further includes determining a current time period between generated crankshaft position pulses, and dividing either the first value or the second by the first time period to obtain either an event-based hydraulic deactivation delay or an event-based hydraulic reactivation delay. The event-based delays are thereafter used to synchronize the timing of solenoid operation when deactivating or reactivating given engine cylinders.

16 Claims, 2 Drawing Sheets

OTHER PUBLICATIONS

Yacoud, Yasser; and Atkinson, Chris; "Modularity in Spark Ignition Engines: A Review of its Benefits, Implementation and Limitations," SAE Publication No. 982688 (New York, NY; 1998).

Zheng, Quan; "Characterization of the Dynamic Response of a Cylinder Deactivation Valvetrain System," SAE Publication No. 2001-01-0669 (New York, NY; 2001).

Leone, T.G.; and Pozar, M.; "Fuel Economy Benefit of Cylinder Deactivation—Sensitivity to Vehicle Application and Operating Constraints," SAE Paper No. 2001-01-3591 (New York, NY; 2001).

Patton, Kenneth J; Sullivan, Aaron M.; Rask, Rodney B.; and Theobald, Mark A.; "Aggregating Technologies for Reduced Fuel Consumption: A Review of the Technical Content in the 2002 National Research Council Report on CAFÉ," SAE Paper No. 2002-01-0628 (New York, NY; 2002).

Falkowski, Alan G.; McElwee, Mark R.; and Bonne, Michael A.; "Design and Development of the Daimlerchrysler 5.7l Hemi Engine Multi -Displacement Cylinder Deactivation System," SAE Publication No. 2004-01-2106 (New York, NY, May 7, 2004).

METHOD AND CODE FOR DETERMINING EVENT-BASED CONTROL DELAY OF HYDRAULICALLY-DEACTIVATABLE VALVE TRAIN COMPONENT

FIELD OF THE INVENTION

The invention relates generally to methods and computer-executable code for controlling the operation of an internal combustion engine for a motor vehicle that features deactivatable cylinders.

BACKGROUND OF THE INVENTION

The prior art teaches equipping vehicles with "variable displacement," "displacement on demand," or "multiple displacement" internal combustion engines in which one or more cylinders may be selectively "deactivated," for example, to improve vehicle fuel economy when operating under relatively low-load conditions. Typically, in a multi-displacement system, the engine's cylinders are deactivated through use of deactivatable valve train components, such as the deactivating valve lifters as disclosed in U.S. patent publication no. U.S. 2004/0244751 A1, in which a supply of pressurized engine oil is selectively delivered from an engine oil gallery to a deactivatable valve lifter through operation of a solenoid valve under the control of an engine control module.

With the intake and exhaust valves of each deactivated cylinder remaining in their closed positions during engine operation in the cylinder-deactivation mode, combustion gases are trapped within each deactivated cylinder, whereupon the deactivated cylinders operate as "air springs" to reduce engine pumping losses. When vehicle operating conditions are thereafter deemed to require an engine output torque greater than that achievable without the contribution of the deactivated cylinders, as through a heightened torque request from the vehicle operator (based upon a detected position of the vehicle's accelerator pedal), the deactivatable valve train components are returned to their nominal activated state to thereby "reactivate" the deactivated cylinders. More specifically, under one prior art approach, Preferably, the engine control module operates the solenoid valve such that the lifter's locking pins are moved between their respective locked and unlocked positions as the lifter's cam lies on the base circle of its corresponding cam surface, thereby minimizing lifter wear and noise. Thus, the triggering of the oil control solenoids is preferably synchronized either to the crankshaft in a pushrod engine, or the cam shaft in an overhead cam engine.

It is also known that, at each engine speed, there is a range of potential solenoid trigger points that produce a proper sequencing of the deactivatable valve train components, with the deactivation triggering window being significantly "wider" than the reactivation window because less time is needed to increase the oil gallery pressure to the relatively-lower unlatching pressure, as opposed to dropping the oil gallery pressure from a relatively-higher sustained pressure down to the latching pressure. Further, it is known that a hydraulic delay exists in a multi-displacement system between the commanded hydraulic control and the actual response, I.e., the change in the solenoid's state and the corresponding change in the state of the hydraulically-deactivatable valve train component, as the control pressure increase or decrease propagates from the solenoid to the component.

The prior art has sought to provide the engine control module with an estimation of this hydraulic delay, for example, by mapping computer-modeled and empirically-confirmed hydraulic response times in a lookup table as a function of oil pressure and estimated oil aeration. However, to the extent that a multi-displacement system is characterized both by a generally negligible oil pressure impact on hydraulic delay over the engine's nominal operating range, as well as a generally negligible amount of oil aeration at normal engine operating speeds, the prior art approach will fail to provide the required time-based hydraulic delay estimates. Accordingly, there is a need to determine the hydraulic deactivation and reactivation control delays as a function of engine operating parameters providing a higher resolution than known methods based on oil pressure and estimated oil aeration.

BRIEF SUMMARY OF THE INVENTION

In accordance with an aspect of the invention, a method and associated computer-executable code for determining an event-based hydraulic control delay in a multi-displacement system for an internal combustion engine, with which to adjust the triggering a solenoid in hydraulic communication with a hydraulically-deactivatable valve train component, includes retrieving from a lookup table a mapped value representative of a time-based hydraulic delay based on a current engine speed and a current oil temperature. The method further includes determining a current time period between generated crankshaft position pulses, and dividing the retrieved time-based value for hydraulic delay by the first time period to obtain the desired event-based hydraulic deactivation or reactivation delay. The event-based delays are thereafter used to synchronize the timing of solenoid operation when deactivating or reactivating a given engine cylinder.

In accordance with an aspect of the invention, separate lookup tables are used to provide the mapped values for the hydraulic deactivation time-based delay and the hydraulic reactivation time-based delays. In an exemplary method, the mapped values are derived empirically, for example, by running a multi-displacement engine over predetermined engine speed and oil temperature ranges in a test cell while proximity probes on the engine's deactivatable valves measures the system's hydraulic response times. The resulting values for the hydraulic time-based delays, mapped as a function of engine speed and oil temperature, provides a significantly higher resolution than the prior art hydraulic delays mapped as a function of oil pressure and estimated oil aeration, particularly when used in a multi-displacement system characterized both by a generally negligible oil pressure impact on hydraulic delay over the engine's nominal operating range, and a generally negligible amount of oil aeration at normal engine operating speeds.

Other objects, features, and advantages of the present invention will be readily appreciated upon a review of the subsequent description of the preferred embodiment and the appended claims, taken in conjunction with the accompanying Drawings.

DETAILED DESCRIPTION OF THE INVENTION

Figure 1:
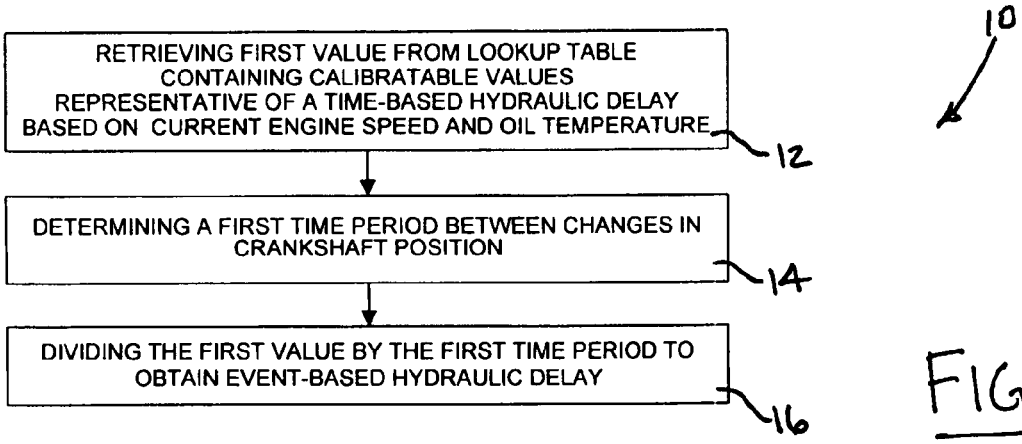
FIG. 1 is a flow chart illustrating the main steps of a method for determining an event-based hydraulic deactivation or reactivation delay for a multi-displacement system of an internal combustion engine.

A method 10 for determining an event-based hydraulic control delay in a multi-displacement system for an internal combustion engine, with which to adjust the triggering a solenoid in hydraulic communication with a hydraulically-deactivatable valve train component, is illustrated generally in FIG. 1. Preliminarily, it is noted that the invention contemplates any suitable systems and methods for deactivating selected cylinders to thereby enable engine operation in a partial-displacement mode, such as the multi-displacement system disclosed in U.S. patent publication no. U.S. 2004/0244751 A1, the teachings of which are hereby incorporated by reference. Significantly, such a multi-displacement system is characterized both by a generally negligible oil pressure impact on hydraulic delay over the engine's nominal operating range, and a generally negligible amount of oil aeration at normal engine operating speeds.

As seen in FIG. 1, the method 10 generally includes retrieving, at block 12, a value representative of a time-based hydraulic delay from a lookup table based on a current engine speed and a current oil temperature. Preferably, one lookup table is provides mapped values for the hydraulic deactivation (oil gallery "fill") time-based delay, while another lookup table provides mapped values for the hydraulic reactivation (oil gallery "drain") time-based delays. In a constructed embodiment, the mapped values contained in each table are derived empirically, for example, by running the multi-displacement engine in a test cell over predetermined engine speed and oil temperature ranges (the latter perhaps being inferred from a detected engine coolant temperature range) while proximity probes determine valve lifter response to solenoid-generated hydraulic "fill" and "drain" commands.

Referring again to FIG. 1, the method 10 further includes determining, at block 14, a current time period between generated crankshaft position pulses and, at block 16, dividing the retrieved time-based value for hydraulic delay by the first time period to obtain the desired event-based hydraulic deactivation or reactivation delay. The event-based delays are thereafter used to synchronize the timing of solenoid operation when deactivating or reactivating a given deactivatable cylinder.

Figure 2:
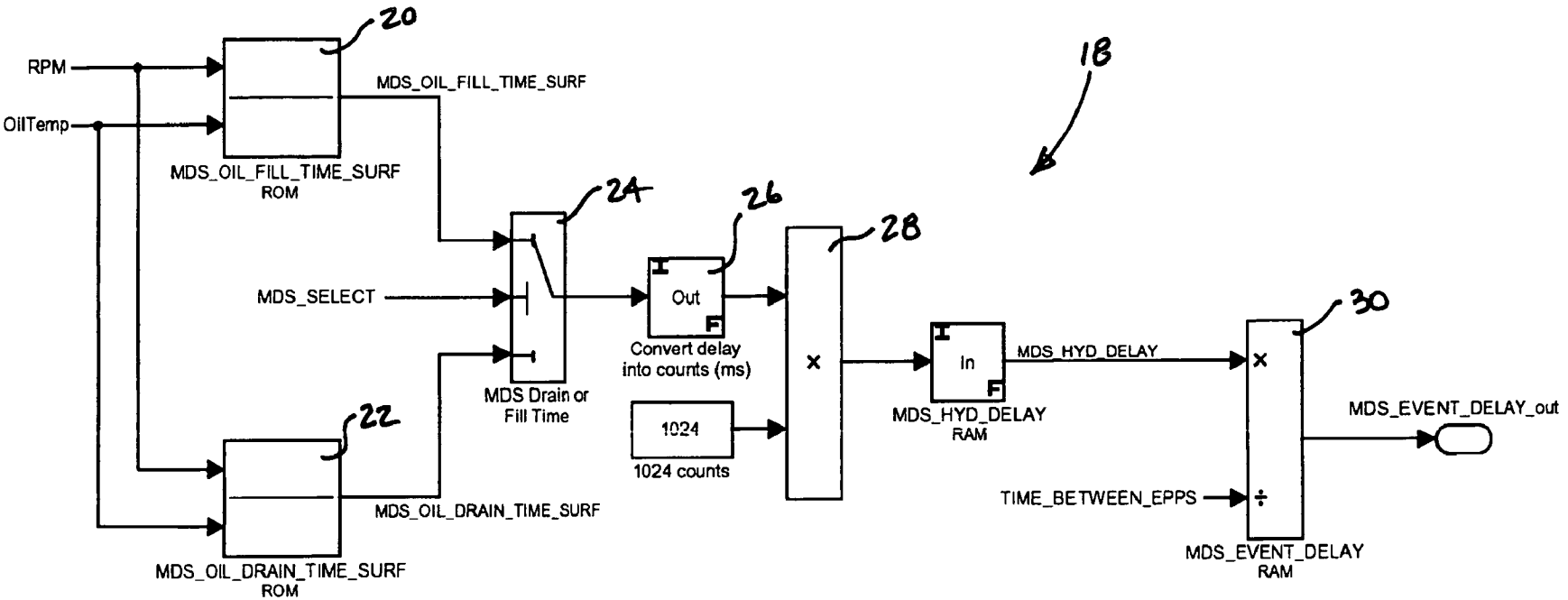
FIG. 2 shows an exemplary computer-executable process for determining an event-based hydraulic deactivation or reactivation delay for a multi-displacement system of an internal combustion engine, in accordance with the invention.

Referring to FIG. 2, an exemplary computer-executable process 18 for determining an event-based hydraulic deactivation or reactivation delay MDS_EVENT_DELAY_out for an engine's multi-displacement system includes retrieving respective mapped values for a time-based hydraulic deactivation ("fill") delay and a time-based hydraulic reactivation ("drain") delay from a pair of lookup tables 20,22 based on a current engine speed and a current oil temperature. Upon selecting one or the other of the time-based values at a switch 24, responsive to a suitable flag MDS_SELECT, the selected time-based value is first converted into milliseconds and then to seconds at blocks 26 and 28, for compatibility with a determined time interval TIME_BETWEEN_EPPS between the engine position pulses generated by a Hall-effect crankshaft position sensor (not shown). The resulting time-based delay value MDS_HYD_DELAY is supplied with the determined crankshaft position pulse interval TIME_BETWEEN_EPPS to a divider block 30, which outputs the desired event-based hydraulic delay MDS_EVENT_DELAY_out.

Figure 3:
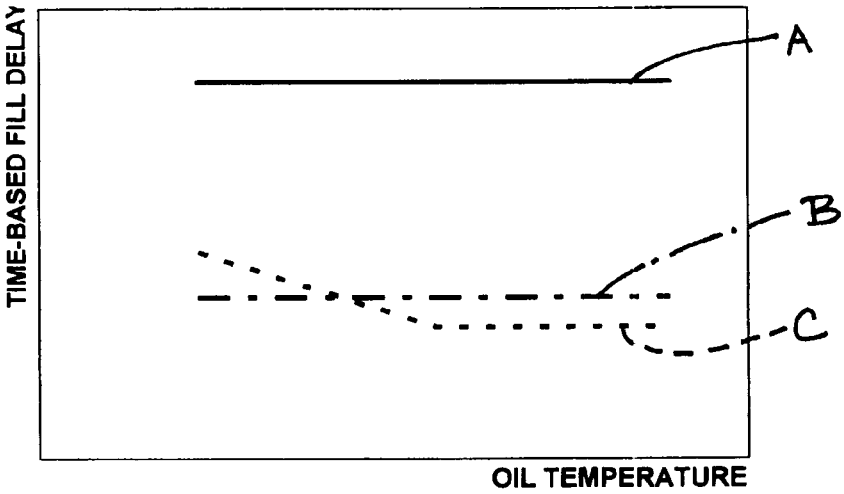
FIG. 3 is a plot illustrating three "sections" of a first three-dimensional lookup table from which to retrieve a first value for a time-based hydraulic deactivation or "fill" delay using current engine speed and current oil temperature, for use in the exemplary process of FIG. 2.
Figure 4:
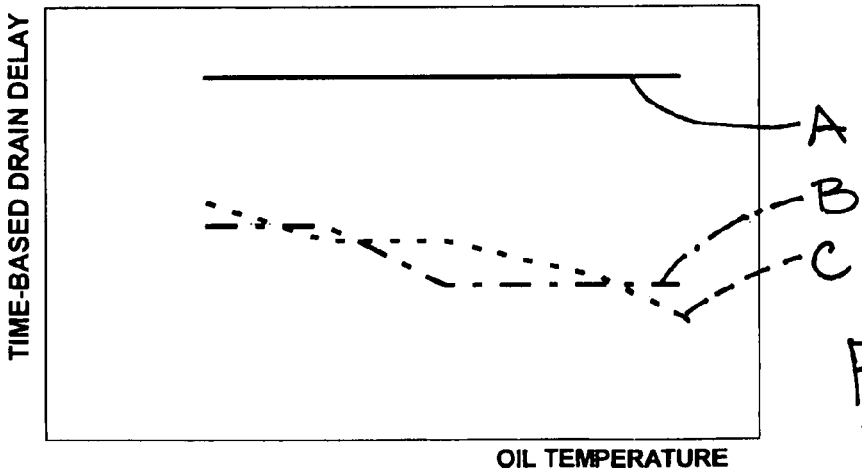
FIG. 4 is a plot illustrating three sections of a second three-dimensional lookup table from which to retrieve a second value for a time-based hydraulic reactivation or "drain" delay using current engine speed and current oil temperature, for use in the exemplary process of FIG. 2.

By way of example only, FIG. 3 is a plot of the empirically-established time-based hydraulic deactivation ("fill") delay versus oil temperature, for each of a low engine speed (plot A), a medium engine speed (plot B), and a high engine speed (plot C), thereby illustrating three "sections" of the first three-dimensional lookup table 20 used in the exemplary process 18 of FIG. 2. Similarly, FIG. 4 is a plot of the empirically-established time-based hydraulic reactivation ("drain") delay versus oil temperature, for each of the same low, medium, and high engine speeds (plots A, B, and C, respectively), thereby illustrating three "sections" of the second three-dimensional lookup table 22 used in the exemplary process 18 of FIG. 2. In FIG. 3, plot A, from which to retrieve a first value for a time-based hydraulic deactivation or "fill" delay using current engine speed and current oil temperature, while FIG. 4 illustrates three sections of a second three-dimensional lookup table from which to retrieve a second value for a time-based hydraulic reactivation or "drain" delay using current engine speed and current oil temperature, for use in the exemplary process of FIG. 2.

While the above description constitutes the preferred embodiment, it will be appreciated that the invention is susceptible to modification, variation and change without departing from the proper scope and fair meaning of the subjoined claims.

What is claimed is:

1. A method for controlling a multi-displacement system for an internal combustion engine, wherein the multi-displacement system includes a solenoid in hydraulic communication with a hydraulically-deactivatable valve train component, the solenoid being triggered using an event-based timer correlated with changes in a crankshaft position as detected by a crankshaft sensor, the method comprising:

when operating the engine in a full-displacement mode at a first engine speed and a first engine oil temperature, retrieving a first value from a plurality of calibratable values representative of a time-based hydraulic deactivation delay based on the first engine speed and the first oil temperature;

determining a first time period between current changes in crankshaft position;

dividing the first value by the first time period to obtain an event-based hydraulic deactivation delay; and triggering the solenoid to move from a closed position to an open position based on the hydraulic deactivation delay.

2. The method of claim 1, including detecting the first oil temperature with an oil temperature sensor.

3. The method of claim 1, further including determining the first oil temperature based on a detected temperature of an engine coolant.

4. A method for determining an event-based hydraulic control delay in a multi-displacement system for an internal combustion engine, wherein the multi-displacement system includes a solenoid in hydraulic communication with a hydraulically-deactivatable valve train component, the solenoid being triggered using an event-based timer correlated with changes in a crankshaft position as detected by a crankshaft sensor, the method comprising:

retrieving a first value from a plurality of calibratable values representative of a time-based hydraulic delay based on a current engine speed and a current oil temperature;

determining a first time period between changes in crankshaft position; and dividing the first value by the first time period.

5. The method of claim 4, including detecting the current oil temperature with an oil temperature sensor.

6. The method of claim 4, further including determining the current oil temperature based on a detected temperature of an engine coolant.

7. The method of claim 4, wherein the crankshaft sensor generates a position pulse train upon rotation of the crankshaft, and wherein determining the first time period includes measuring a time lapse between position pulses.

8. The method of claim 4, wherein the first value represents a hydraulic deactivation delay, and further including triggering the solenoid to move from a closed position to an open position based on the hydraulic deactivation delay.

9. The method of claim 4, wherein the first value represents a hydraulic reactivation delay, and further including triggering the solenoid to move from an open position to a closed position based on the hydraulic reactivation delay.

10. The method of claim 4, wherein the crankshaft sensor generates a position pulse train upon rotation of the crankshaft, and wherein determining the first time period includes measuring a time lapse between position pulses.

11. The method of claim 4, further including:

when operating the engine in a cylinder-deactivation mode at a second engine speed and a second engine oil temperature, retrieving a second value from a plurality of calibratable values representative of a time-based hydraulic reactivation delay based on the second engine seed and the second oil temperature, determining a second time period between current changes in crankshaft position;

dividing the second value by the second time period to obtain an event-based hydraulic reactivation delay; and triggering the solenoid to move from the open position to the closed position based on the hydraulic reactivation delay.

12. A computer-readable storage medium including computer executable code for determining an event-based hydraulic control delay in a multi-displacement system for an internal combustion engine, wherein the multi-displacement system includes a solenoid in hydraulic communication with a hydraulically-deactivatable valve train component, the solenoid being triggered using an event-based timer correlated with changes in a crankshaft position as detected by a crankshaft sensor, the method comprising:

code for retrieving, from a lookup table, a first value from a plurality of calibratable values representative of a time-based hydraulic delay based on a current engine speed and a current oil temperature;

code for determining a first time period between changes in crankshaft position; and code for dividing the first value by the first time period.

13. The storage medium of claim 12, including code for determining the current oil temperature based upon an output of one of the group consisting of an oil temperature sensor and an engine coolant sensor.

14. The storage medium of claim 12, wherein the code for determining the first time period includes code for measuring a time lapse between crankshaft position pulses.

15. The storage medium of claim 12, wherein the first value represents a hydraulic deactivation delay, and further including code for triggering the solenoid to move from a closed position to an open position based on the hydraulic deactivation delay.

16. The storage medium of claim 12, wherein the first value represents a hydraulic reactivation delay, and further including code for triggering the solenoid to move from an open position to a closed position based on the hydraulic reactivation delay.

* * * * *